US006021715A

United States Patent [19]

Fritz et al.

[11] Patent Number: 6,021,715

[45] Date of Patent: Feb. 8, 2000

[54] MANIFOLD FOR COUPLING WITH A TUBE AND METHOD THEREOF

[75] Inventors: James E. Fritz, Ellington; John A. Graham, Middletown; Jon E. Rydberg, Avon; Steven L. Olson, W. Hartford, all of Conn.

[73] Assignee: The Ensign-Bickford Company, Simsbury, Conn.

[21] Appl. No.: 09/052,507

[22] Filed: Mar. 31, 1998

Related U.S. Application Data

[60] Provisional application No. 60/045,481, May 2, 1997.

[51] Int. Cl.[7] ..... F42B 15/10; C06C 5/06; B64D 1/04

[52] U.S. Cl. ..... 102/378; 102/275.11; 89/1.14

[58] Field of Search ..... 102/378, 377, 102/275.11, 275.12; 89/1.14

[56] References Cited

U.S. PATENT DOCUMENTS

| | | | |
|---|---|---|---|
| 845,374 | 2/1907 | Reed . | |
| 1,950,947 | 3/1934 | Mulroyan | 285/203 |
| 2,516,689 | 7/1950 | France et al. | 138/64 |
| 3,084,597 | 4/1963 | Beyer . | |
| 3,230,885 | 1/1966 | Weber et al. | 89/1.14 |
| 3,290,770 | 12/1966 | Silverman et al. | 29/421 |
| 3,290,771 | 12/1966 | Silverman et al. | 29/421 |
| 3,343,248 | 9/1967 | Silverman et al. | 29/200 |
| 3,362,290 | 1/1968 | Carr et al. . | |
| 3,486,410 | 12/1969 | Drexelius et al. . | |
| 3,505,925 | 4/1970 | Carr | 102/378 |
| 3,633,456 | 1/1972 | Carr et al. . | |
| 3,693,247 | 9/1972 | Brown | 29/512 |
| 3,698,281 | 10/1972 | Brandt et al. . | |
| 3,833,984 | 9/1974 | Dietzel . | |
| 3,929,072 | 12/1975 | Zapf . | |
| 4,137,848 | 2/1979 | Cunha . | |
| 4,664,033 | 5/1987 | Burkdoll et al. | 102/275.2 |
| 4,685,376 | 8/1987 | Noel et al. | 89/1.14 |
| 4,825,764 | 5/1989 | Jullien | 102/202.14 |
| 4,879,941 | 11/1989 | Repé et al. | 89/1.14 |
| 5,109,749 | 5/1992 | Olcer | 89/1.14 |
| 5,123,356 | 6/1992 | Brooks et al. | 102/275.12 |
| 5,129,306 | 7/1992 | Fauvel | 89/1.14 |
| 5,147,976 | 9/1992 | Laurensou et al. | 102/275.3 |
| 5,327,835 | 7/1994 | Adams et al. | 102/275.11 |
| 5,331,894 | 7/1994 | Wassell et al. | 102/275.12 |
| 5,365,851 | 11/1994 | Shaw | 102/275.6 |

(List continued on next page.)

OTHER PUBLICATIONS

E. Raymond Lake, "Confined Explosive Separation System", McDonnell Aircraft Company, pp. 1–6; Jun. 1969.

V. Noel, "Sure–Sep Separation System", MDC H5185, pp. 1–5, Oct. 1989.

S. Renfro et al, AIAA 93–2063, "Development and Modeling of a More Efficient Frangible Separation Joint", pp. 1–8, Jun. 1993.

*Primary Examiner*—Theresa M. Wesson

*Attorney, Agent, or Firm*—Libert & Associates; Frederick A. Spaeth

[57] ABSTRACT

A manifold (130) is configured to have a body portion (131) having at least one initiation port (132) for receiving an initiation device and at least one tapered boss (138) mounted on the body portion (131). The boss (138) has an elliptical cross-sectional configuration and a boss bore (140) for receiving a fuse or linear explosive charge (16) and it communicates with the initiation port (132). There is a clamp member (160) having an aperture (164) dimensioned and configured to generally conform to the boss (138), and tension means such as a set of bolts (166) for urging the clamp member (160) towards the manifold (130). There may be a bushing material (121) on the boss. The manifold (130) may be coupled to a separation device (23) that includes a frangible joint (24) through which is disposed an expansion member (110). The expansion member (110) may have a containment tube (120) and a linear explosive charge (16) within the tube (120), wherein the tube (120) and the charge (16) protrude from the frangible joint (24). The charge (16) is disposed within the boss bore (140) and the tube is clamped between the boss (138) and the clamp member (160).

2 Claims, 4 Drawing Sheets

U.S. PATENT DOCUMENTS

| | | | |
|---|---|---|---|
| 5,372,071 | 12/1994 | Richards et al. | 102/378 |
| 5,390,606 | 2/1995 | Harris | 102/378 |
| 5,392,684 | 2/1995 | Renfro et al. | 89/1.14 |
| 5,402,720 | 4/1995 | Bottorff et al. | 102/378 |
| 5,417,162 | 5/1995 | Adams et al. | 102/317 |
| 5,423,263 | 6/1995 | Rontey et al. | 102/275.12 |
| 5,898,123 | 4/1999 | Fritz et al. | 102/378 |

FIG. IC
PRIOR ART

MANIFOLD FOR COUPLING WITH A TUBE AND METHOD THEREOF

This application claims the benefit of U.S. Provisional Application Serial No. 60/045,481, filed May 2, 1997.

BACKGROUND OF THE INVENTION

1. Field of the Invention

This invention relates to a manifold to which a tube may be coupled, and to a method for coupling the tube and the manifold. In particular, the invention relates to a detonation manifold for a separation device.

Separation devices are used when it is desired to effect a separation of two structures that were previously adjoined to one another. Such devices join the structures to be separated and are later ruptured along a separation line to release the structures from one another. A separation device with which the present invention may be used typically comprises a frangible joint within which is disposed an expansion member. The frangible joint comprises a pair of joinder flanges interconnected by a release portion. Typically, the release portion comprises a channel within which the expansion member is disposed, and there is a groove disposed along the channel to provide a fracture seam. The expansion member comprises a deformable containment tube within which an elastomeric charge holder supports a linear explosive charge, typically a mild detonation fuse. Before separation, the joinder flanges are secured to respective structures, e.g., a fairing or a field joint adapter on a rocket, missile or payload platform, that are to be separated, and the release portion keeps the assembly together.

It is known to couple the linear explosive charge to an initiation device through the use of a detonation manifold. Detonation of the initiation device then initiates the linear explosive charge, which deforms the expansion tube and thus fractures the release portion of the frangible joint along the groove to separate the structures. The containment tube prevents the release of shrapnel and of chemical by-products of the detonation of the charge in the expansion member, thus preventing damage to the structures or objects therein from shrapnel or other detonation by-products.

2. Related Art

U.S. Pat. No. 5,331,894 to Wassell et al, dated Jul. 26, 1994, states that a conventional flange may be dimensioned and configured to have a circular external cross-sectional configuration. To engage the containment tube to the flange, the end of the tube is flared to a circular configuration. The tube is then crimped circumferentially about the flange in a roll crimp procedure. It is further necessary to secure the circular crimps with retaining bands to assure that the crimps will not be undone upon detonation of the cord (see column 1, line 46 through column 2, line 2). This suggests that the flange has a generally uniform, i.e., non-tapered, axial configuration. The invention of U.S. Pat. No. 5,331,894 is represented herein in FIGS. 1A, 1B and 1C.

As seen in FIG. 1A, conventional separation device (23) comprises an expansion member (10) disposed within a frangible joint (24). Frangible joint (24) may comprise an extruded aluminum member having a release portion comprising separation walls **(26*a*, 26*b*) and joinder flanges (27*a*, 27*b*) mounted to the release portion for attachment to the structures to be separably attached. Thus, prior to separation, frangible joint (24) functions like a butt plate. Separation walls (26*a*, 26*b*) also serve to define an internal channel (unnumbered) for receiving expansion member (10). Expansion member (10) comprises a containment tube (20) within which is disposed an elastomeric charge holder (18). Within holder (18) is disposed a linear detonatable charge such as a mild detonation fuse (16). One suitable detonation fuse is known under the designation HNS-IIA Mild Detonating Fuse. Such a fuse typically contains a core of 24 grains per linear foot hexanitrostilbene (HNS) in an aluminum jacket. However, other detonation materials such as cyclotetramethylene tetranitramine (HMX) can be used as well. The elastomeric charge holder (18) may comprise a silicone polymer. Containment tube (20) is made of a material like stainless steel that is sufficiently ductile to deform when fuse (16) detonates, but is also strong enough not to fracture or be perforated by shrapnel released by fuse (16), and so contains the debris and other detonation products released by fuse (16) upon detonation. Generally, expansion member (10) is inserted lengthwise into the channel formed in frangible joint (24). Walls (26*a*, 26*b*) have fracture grooves (28*a*, 28*b*) that are designed to provide a clean fracture of walls (26*a*, 26*b*) along the length of the separation device in response to expansion of the expansion member (10) upon detonation of fuse (16). Thus, joinder flanges (27*a*, 27*b*)** and their associated structures are separated upon detonation of the detonation fuse.

A conventional detonation manifold for use with the separation device (23) of FIG. 1A is seen in FIG. 1B. Manifold (30) includes a body portion (31) having initiation ports (32) for receiving a primary and a secondary initiation device. Detonation manifold (30) includes a mounting flange (34) formed with mounting holes (36) that allow manifold (30) to be attached to one of the structures to be separated. A coupling boss (38) is mounted on body portion (31). Boss (38) has a bore (40) that communicates with initiation port (32) so that a detonation fuse may be passed therethrough into detonation relation with the initiation device in initiation port (32). Coupling boss (38) has a generally oval cross section, with a major axis (42) and a minor axis (44). Boss (38), however, is generally uniform, i.e., it is not tapered, in the axial direction, and has notches (46) that facilitate the use of stake crimps to help fasten tube (20) onto boss (38).

To facilitate joinder of an expansion member to detonation manifold (30) as shown in FIG. 1C, the expansion member is extended out of frangible joint (24) and a portion of the elastomeric charge holder (18) is removed from within the containment tube (20). Before detonation fuse (16) is inserted into bore (40) (FIG. 1B), a booster cap (41) is attached to its end. Such a booster cap may comprise, e.g., a charge of about 96 mg of an HNS-IIA explosive. Tube (20) is initially coupled to boss (38) by a stake crimp (48). A multi-piece locking collar (50) clamps the containment tube (20) to the boss (38), but it does so without force in the direction of the adjacent body portion (31) of manifold (30), and without being able to provide clamping force upon tube (20) about the entire circumference of the tube. Specifically, no radial force is applied to the tube at the point where the pieces of collar (50) mate.

Since the coupling boss (38) and tube (20) are both formed from hard metals and because it is difficult to flare tube (20) into a non-tapered configuration for a good fit on boss (38), this prior art device does not produce plastic deformation of the tube or boss materials, so a good seal between them is not achieved, and gaps often occur between them. Such gaps can be filled by adhesives or sealants, but such materials are not strong enough to survive the transient high pressures that result when the separation device is initiated.

SUMMARY OF THE INVENTION

The present invention relates to a manifold coupling apparatus comprising a manifold comprising a body portion having at least one initiation port for receiving an initiation device. The manifold also has at least one tapered boss mounted on the body portion, the boss having a boss bore for receiving a fuse. The boss bore communicates with the initiation port. The device includes a clamp member having an aperture dimensioned and configured to generally conform to the tapered boss, and tension means for urging the clamp member towards the manifold. Optionally, the tapered surface of the boss may comprise a bushing material.

In a particular application, the invention provides a separation device and initiation manifold assembly. The assembly comprises a frangible joint through which is disposed an expansion member comprising a containment tube and a linear explosive charge within the tube. The tube and the linear explosive charge protrude from the frangible joint. The linear explosive charge is disposed within the boss bore of a manifold as described above, and the tube is clamped between the boss and the clamp member.

The present invention also pertains to a method for coupling a tube onto a tapered boss, wherein the tube has an interior surface and an exterior surface, and the boss is tapered along an axis and has an exterior surface. The method of this invention comprises disposing a clamp member about the tube, the clamp member having a tapered interior surface dimensioned and configured to generally conform to the boss, flaring the end of the tube so that its interior surface is configured to engage the exterior surface of the boss, inserting the boss into the flared end of the tube, and urging the clamp member in an axial direction so that it bears on the flared end of the tube and thus clamps the tube to the boss. Preferably, the boss is mounted on a body portion, and urging the clamp member in an axial direction comprises engaging the clamp member with the body portion.

BRIEF DESCRIPTION OF THE DRAWINGS

FIGS. 1A, 1B and 1C illustrate a prior art separation device and associated initiation manifold; wherein FIG. 1A is a cross-sectional view of a separation device comprising an expansion member;

FIG. 1B is a perspective view of a prior art initiation manifold; and

FIG. 1C is a cross-sectional view of the separation device of FIG. 1A coupled to the manifold of FIG. 1B;

DETAILED DESCRIPTION OF THE INVENTION AND PREFERRED EMBODIMENTS THEREOF

Figure 1A:
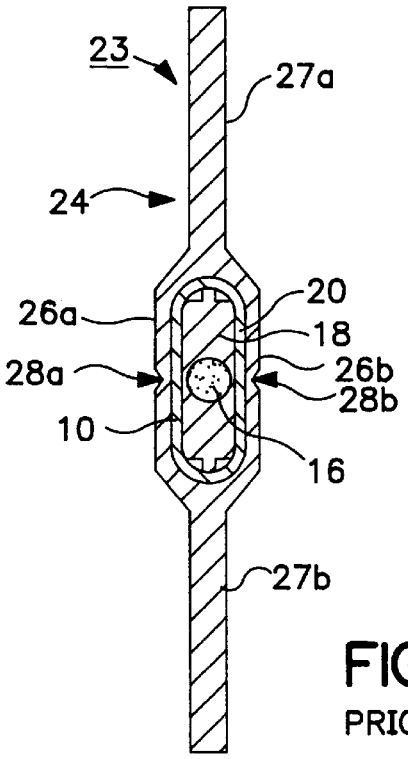
FIG. 1A PRIOR ART
Figure 1B:
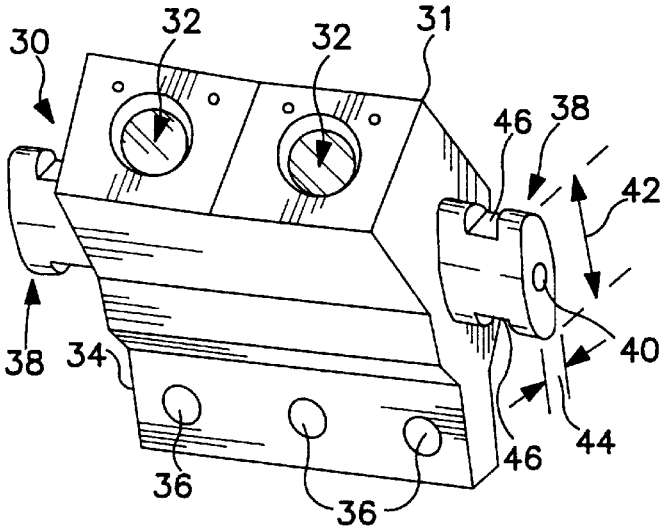
FIG. 1B PRIOR ART

This invention relates to a tube and boss configuration in which the tube is clamped onto the boss, and a method for achieving the configuration. The configuration and method of this invention finds utility in various fields, including the field of separation devices. Relative to prior art in the field of separation devices, the present invention offers the advantage of eliminating the need for a roll crimp or a stake crimp. Thus, this invention optionally simplifies the procedure for assembling a separation device by allowing the exclusion of a step for crimping the tube onto the boss. In addition, the invention allows for the use of a locking collar that is formed as a unitary circumferential structure that can impose a clamping force about the entire circumference of the tube.

The present invention provides a detonation manifold for coupling the linear explosive charge (sometimes referred to herein as the "detonation fuse" or simply the "fuse") of an expansion member in a separation device to an initiation device. A detonation manifold according to the present invention is seen in FIG. 2A, which shows that manifold 130 includes a body portion 131 having an initiation port 132 for receiving an initiation device. A coupling boss 138 is mounted on body portion 131. Boss 138 has a bore 140 that communicates with initiation port 132 so that a detonation fuse may be passed therethrough into detonation relation with the initiation device in initiation port 132. Coupling boss 138 has, in cross section, an oblong, preferably elliptical, configuration having a major axis 142 and a minor axis 144, to reduce the degree of swaging needed to couple tube 120 (FIG. 3), which was an oblong cross-sectional configuration. However, sensed in an axial direction relative to bore 140 and moving away from body portion 131 (to the left in the view of FIG. 2A), boss 138 is tapered, i.e., its cross-sectional dimensions (e.g., major axis 142 and minor axis 144) decrease. Stated differently, boss 138 has a frustum-like configuration with the base of the frustum on body portion 131 of manifold 130.

Figure 2B:
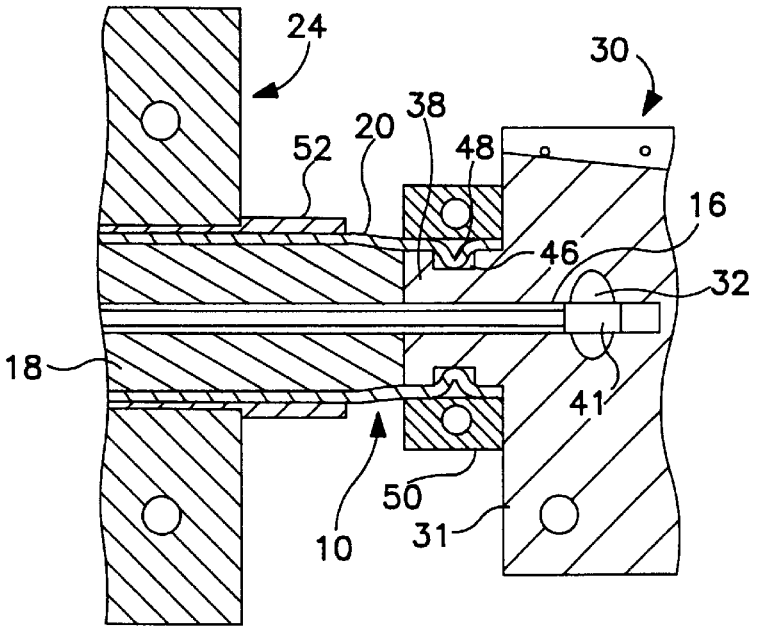
FIG. 2B is a perspective view of a clamp member according to the present invention, for use with the manifold of FIG. 2A.
Figure 2B:
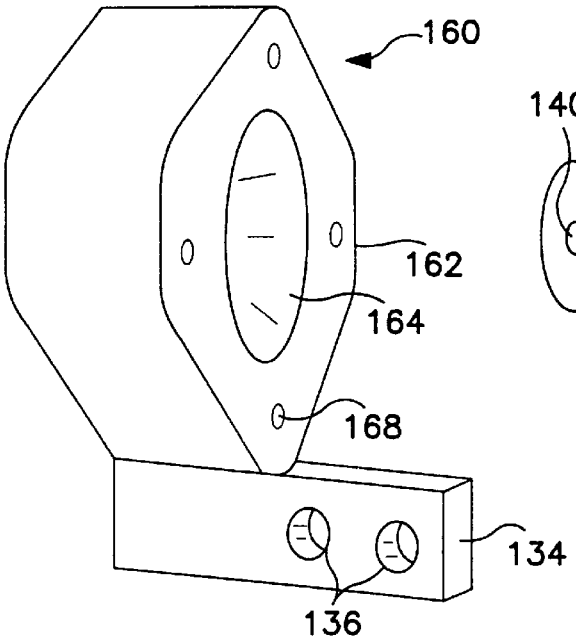
Figure 2A:
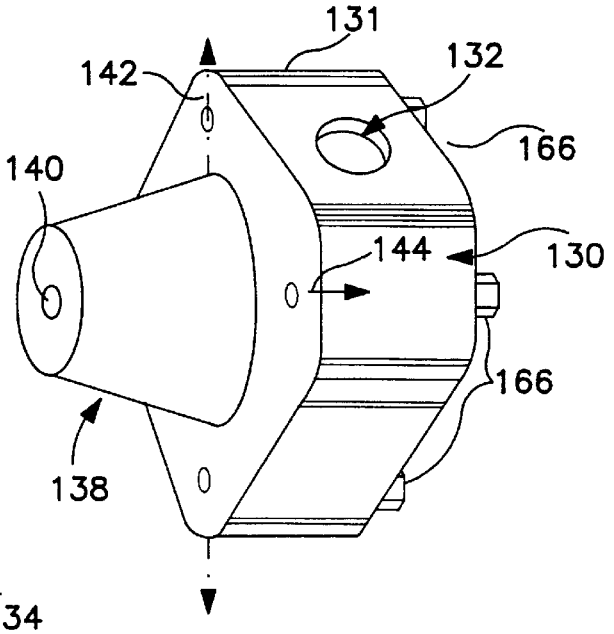
FIG. 2A is a perspective view of a manifold in accordance with a particular embodiment of the present invention.

Manifold 130 is used in combination with a clamp member 160, FIG. 2B. Clamp member 160 has a generally annular body 162 through which extends a clamp aperture 164. Clamp aperture 164 has a tapered configuration that nearly matches the taper of boss 138, so that as boss 138 is inserted into aperture 164, a clamping force is generated on a material disposed about boss 138. A slight difference in taper between the two will produce an interference or "bite" between clamp member 160 and boss 138, for good clamping effect. For example, the clamp aperture has an elliptical cross section that is more eccentric, i.e., the major axis is greater in proportion to the minor axis, at points closer to the interface with the manifold body than at points further away. One or both of clamp member 160 and manifold 130 comprise tension means such as bolts (the heads of which only are shown in dotted outline at 166 (FIG. 2A) and threaded holes 168) so that clamp member 160 can be urged towards manifold 130. At least one of manifold 130 and clamp member 160 (in this case, clamp member 160) comprises a mounting flange 134 with mounting holes 136 so that the manifold and clamp assembly can be mounted onto one of the two devices to be separated.

Figure 3:
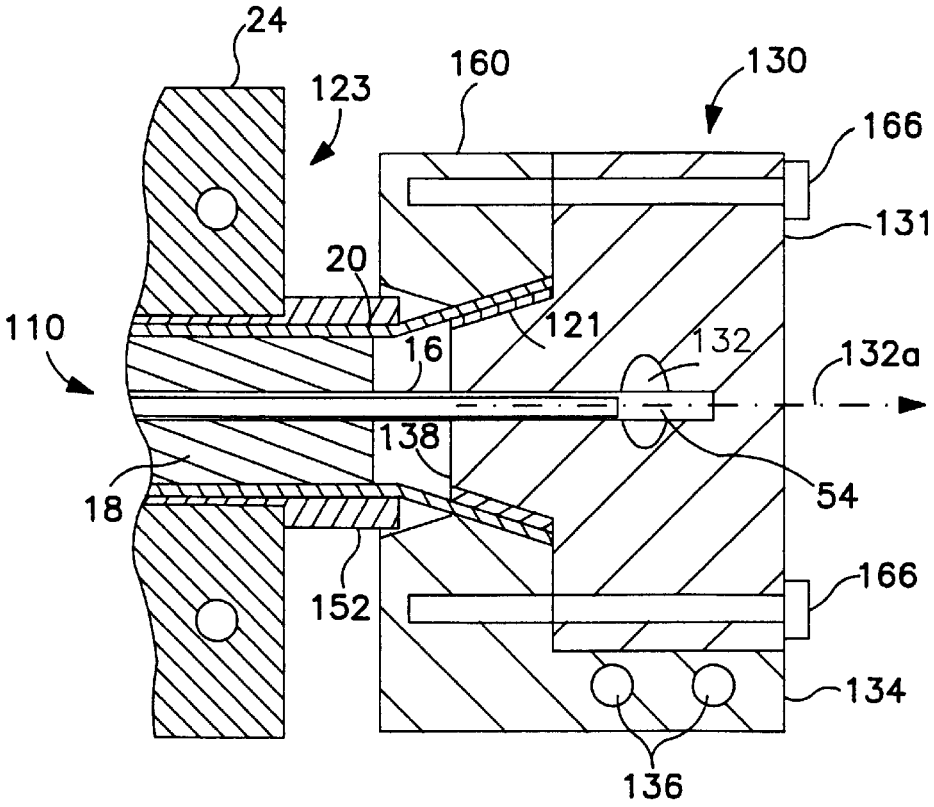
FIG. 3 is a cross-sectional view of a separation device coupled to the manifold of FIG. 2A by the clamp member of FIG. 2B.

As shown in FIG. 3, manifold 130 can be coupled to an expansion member that is used with a conventional frangible joint such as joint 24, FIG. 1A. To facilitate joinder of an expansion member to detonation manifold 130, the expansion member is extended out of the frangible joint and a portion of the elastomeric charge holder 18 is removed from within the containment tube 120 to allow a fuse 16 to extend through boss 138 to initiation port 132. Clamp aperture 164 (FIG. 2B) is dimensioned and configured so that a portion of expansion member 110 that protrudes from frangible joint 24 can be inserted through the aperture. Once this is done, the end of tube 120 is swaged or otherwise flared to conform either to boss 138 or to clamp aperture 164. Before the detonation fuse is inserted into bore 140 (FIG. 2A), a booster cap 54 is attached to its end.

The end of detonation fuse 16 with cap 54 thereon is inserted into the bore 140 (FIG. 2A) of coupling boss 138 (FIG. 3) to a point where cap 54 passes into initiation port 132. Initiation port 132 is illustrated as having an ovoidal configuration because, although it is circular in cross section, initiation port 132 is disposed at an oblique angle with respect to the plane of FIG. 3. The flared end of containment tube 120 is configured to engage the tapered surface of boss 138. Boss 138 may comprise at its tapered surface a bushing material 121 that provides good contact, preferably sealing contact, with tube 120 to yield a compression seal when the tube is clamped thereon. Accordingly, material 121 comprises a layer of a metal that is softer than the material of containment tube 120 and the body portion 131 of manifold 130. For example, bushing material 121 may comprise copper, lead, tin, pewter, aluminum, gold or silver. The exposed portion of containment tube 120, if any, is reinforced for support against the force of the detonation of fuse 16 by a reinforcement ring 152 thereon before engaging expansion member 110 with detonation manifold 130.

Once boss 138 is disposed within the flared end of tube 120, clamp member 160 is urged in an axial direction, i.e., in a direction coinciding with the axis along which boss 138 tapers. For example, bolts 166 may be inserted and tightened, thus engaging the clamp member with the manifold 130 to urge clamp member 160 in an axial direction toward manifold 130, in the direction of arrow 132*a*. This imposes a force that clamps tube 120 against boss 138. As the bolts are tightened, the metal sleeve is deformed against the tube, creating a good metal-to-metal compression seal.

When the detonation fuse 16 is fully inserted into the flange bore 140 (FIG. 3), an initiation device (not shown) can be inserted into the initiation port 132 to be disposed in detonation relation with detonation fuse 16, at right angles thereto. The typical initiation device may be a flexible confined detonating cord (FCDC) having a cap on the end loaded with an HNS-IIA charge. To effect separation, the initiation device, the FCDC, is detonated, and the HNS-IIA-loaded cap detonates booster cap 54 (FIG. 3) on the detonation fuse 16 of the expansion member 110. Preferably, detonation manifold 130 is dimensioned and configured to fully contain these detonation reactions, i.e., to inhibit the release therefrom of shrapnel or other detonation by-products. The detonation of detonation fuse 16 causes the flattened containment tube 120 to expand laterally, fracturing the frangible joint 24 at grooves 28*a*, 28*b* (FIG. 1A), thus separating joinder flanges 27*a*, 27*b* and the associated structures.

Optionally, the separation device 123 may have an initiation manifold 130 secured at each end to containment tube 120. This will allow the use of a redundant initiation device, for improved reliability of separation.

Figure 4:
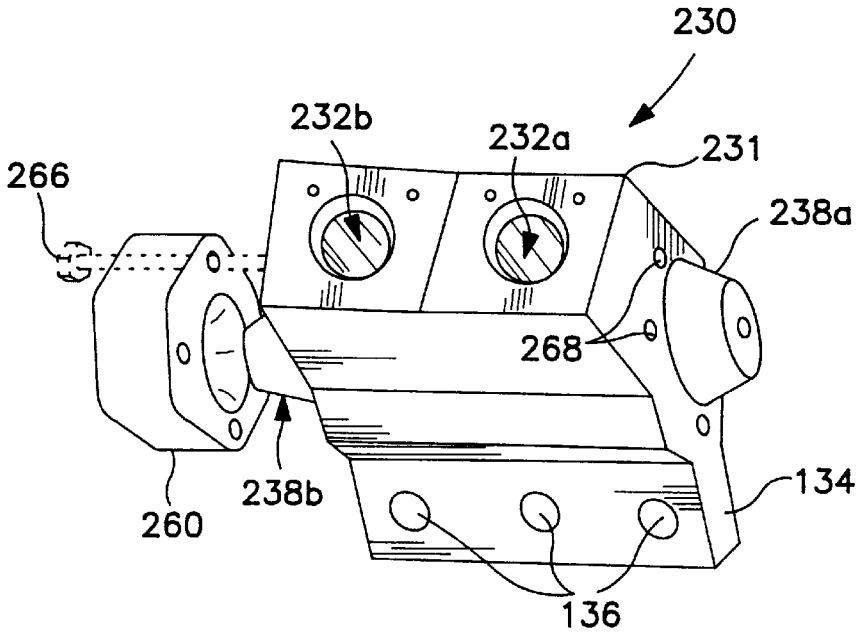
FIG. 4 is a perspective view of a manifold in accordance with an alternative embodiment of the present invention.
Figure 5:
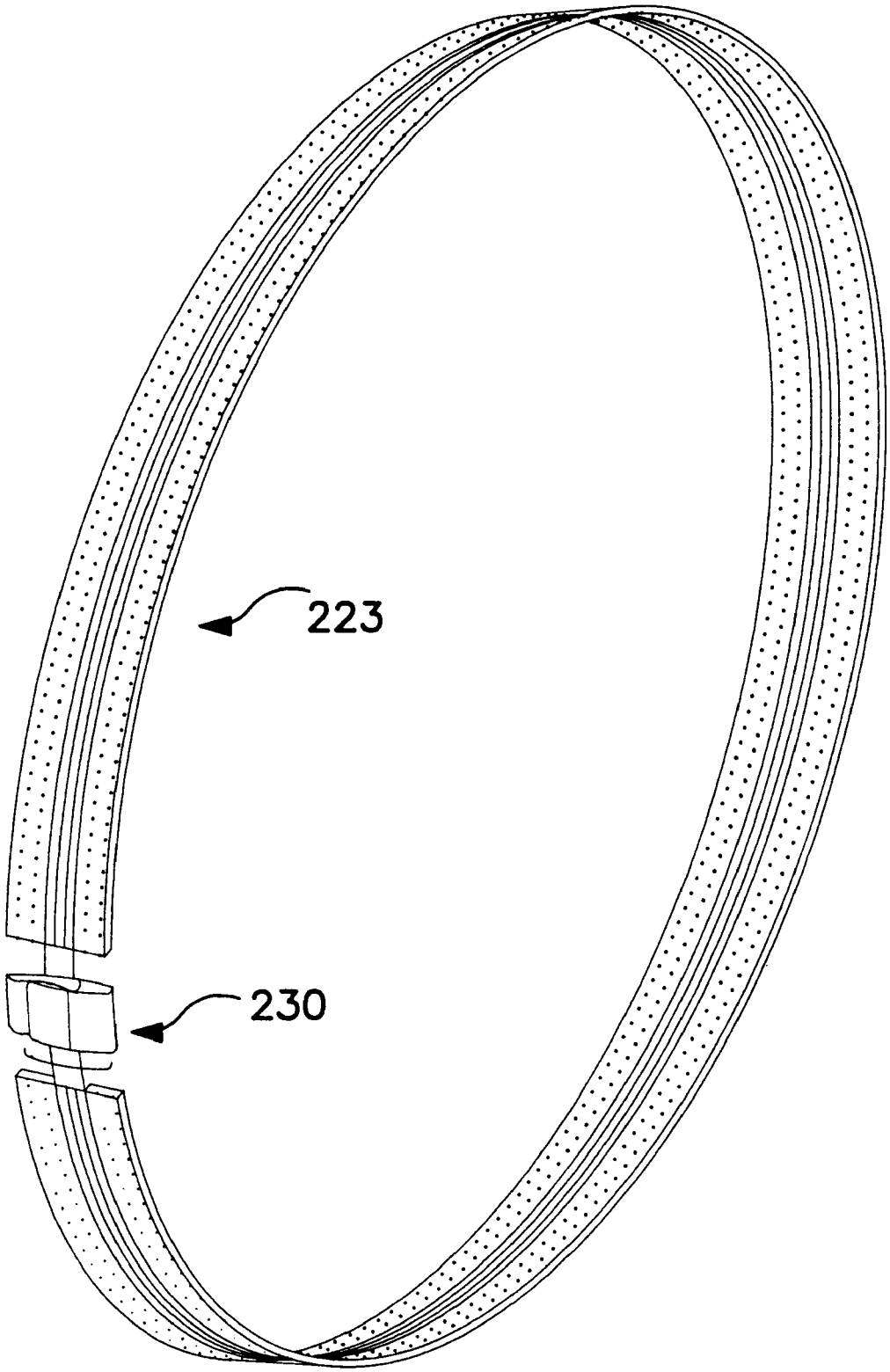
FIG. 5 is a perspective view of a separation device and manifold assembly comprising the manifold of FIG. 4.

In an alternative embodiment, a manifold in accordance with the present invention may comprise two coupling bosses. The manifold may be configured so that fuse ends on both bosses can be initiated by the same initiation device, so that both can be serviced by the same initiation port 132. However, such an embodiment would typically provide a separate initiation port for each end of a detonation fuse therein. Thus, manifold 230, FIG. 4, comprises two tapered bosses 238*a*, 238*b* that extend in opposite directions from each side of body portion 231, and two initiation ports, 232*a*, 232*b*, one for each boss. Note that body portion 231 is equipped with threaded holes 268 to receive bolts (such as bolt 266) that will pass through the clamps (such as clamp member 260) to be used therewith, as the tension means for this embodiment. Such an embodiment facilitates the manufacture of a circular separation device 223, as suggested in FIG. 5. Circular separation devices are particularly useful to facilitate the separation of rocket stages and the like. Typically, however, the circular separation device 223 will incorporate therein at least two detonation manifolds distributed thereabout so that stresses imposed on the tube-boss seal as a result of, e.g., thermal expansion and contraction of the separation device, are reduced.

While the invention has been described in detail with respect to particular embodiments thereof, it will be apparent that upon a reading and understanding of the foregoing, numerous alterations to the described embodiments will occur to those skilled in the art and it is intended to include such alterations within the scope of the appended claims.

What is claimed is:

1. A separation device and initiation manifold assembly comprising:

a frangible joint through which is disposed an expansion member comprising a containment tube and a linear explosive charge within the tube, wherein the tube and the linear explosive charge protrude from the frangible joint;

a manifold comprising a body portion having at least one initiation port for receiving an initiation device and at least one tapered boss mounted on the body portion, the boss having a boss bore for receiving a fuse, the boss bore communicating with the initiation port;

a clamp having an aperture dimensioned and configured to generally conform to the tapered boss; and bolts urging the clamp to the manifold;

wherein the linear explosive charge is disposed within the boss bore and the tube is clamped between the boss and the clamp member.

2. The assembly of claim 1 wherein the boss comprises a tapered surface comprising a bushing material.

* * * * *